US007474320B2

(12) United States Patent
Yoder et al.

(10) Patent No.: US 7,474,320 B2
(45) Date of Patent: Jan. 6, 2009

(54) METHOD FOR SETTING COLOR THERMAL PAPER PARAMETERS

(75) Inventors: Robert D. Yoder, Cary, NC (US); James D. Piette, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 324 days.

(21) Appl. No.: 11/362,995

(22) Filed: Feb. 27, 2006

(65) Prior Publication Data

US 2007/0200909 A1 Aug. 30, 2007

(51) Int. Cl.
*B41J 2/315* (2006.01)

(52) U.S. Cl. ..... 347/171

(58) Field of Classification Search ..... None
See application file for complete search history.

(56) References Cited

U.S. PATENT DOCUMENTS

| | | | | |
|---|---|---|---|---|
| 6,034,705 | A * | 3/2000 | Tolle et al. | 347/195 |
| 6,417,878 | B2 * | 7/2002 | Tourai et al. | 347/183 |
| 6,476,839 | B1 * | 11/2002 | Nakajima et al. | 347/195 |
| 2002/0126197 | A1 | 9/2002 | Minowa et al. | 347/193 |
| 2002/0158958 | A1 | 10/2002 | Spano | 347/195 |

* cited by examiner

*Primary Examiner*—K. Feggins
(74) *Attorney, Agent, or Firm*—Cantor Colburn LLP; Jeannie Ray-Yarletts

(57) ABSTRACT

A method for setting color thermal paper parameters including: printing a first color at one or more printing speeds, wherein one or more first color images are produced; selecting the first color image with a desired quality; printing a second color at one or more energy levels at the printing speed corresponding to the selected first color image, wherein one or more second color images are produce; selecting the second color image with the desired quality; and storing a printer parameter corresponding to the selected first and second color images.

5 Claims, 2 Drawing Sheets

METHOD FOR SETTING COLOR THERMAL PAPER PARAMETERS

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND

1. Field of the Invention

This invention relates generally to the field of thermal printing and specifically to color separation, calibration and control of printer parameters.

2. Description of Background

There are a number of different types of printers commercially available, but not all types are suited to be point-of-sale (POS) printers. POS printers are used to print cash register receipts or credit card charge statements. Full color printing is not required, nor is the ability to print on different types of paper. POS printers tend to be compact so as not to clutter up a cashier's work area.

Many types of POS single color printers are commercially available. Dot matrix printers, thermal printers, and ink jet printers are all used because of their speed and reliability. POS color printers are rare in the marketplace. POS dot matrix color printers require a multi-colored ribbon, which adds to the complexity and size of the printer. Color ink jet printers are unsuitable for POS printers because adding three additional ink jet cartridges for full color (also known as 4-color, i.e., three colors plus black) would add width and complexity to the printer. Color thermal printers are under development, but it is hard to do color graphics on a thermal printer. In addition, special paper is required.

Briefly stated, a 2-color thermal point of sale (POS) printer includes a converter for converting full color printing commands into commands for printing in two colors, a primary color and an alternate color. A three-color image is possible when using the background color of the paper as a color.

Line thermal printers and other types of thermal printers have numerous independently heat-driven thermal elements arranged in line, and print by selectively driving these thermal elements to impart heat to the corresponding position of an oppositely positioned heat sensitive paper, thereby causing the heat sensitive paper to change color. The color produced in the heat sensitive paper by this type of printer differs according to the amount of heat energy imparted by the thermal element. As a result, actual print results, such as the color density, will also differ according to whether or not a selected thermal element was driven immediately before, i.e. whether or not a selected thermal element has residual heat.

SUMMARY

Exemplary embodiments include a method for setting color thermal paper parameters including: printing a first color at one or more printing speeds, wherein one or more first color images are produced; selecting the first color image with a desired quality; printing a second color at one or more energy levels at the printing speed corresponding to the first color selected image, wherein one or more second color images are produced; selecting the second color image with the desired quality; and storing a printer parameter corresponding to the selected first and second color images.

Exemplary embodiments also include a computer program product for setting color thermal paper parameters, the computer program product including: a storage medium readable by a processing circuit and storing instructions for execution by the processing circuit for facilitating a method including: printing a first color at one or more printing speeds, wherein one or more first color images are produced; selecting the first color image with a desired quality; printing a second color at one or more energy levels at the printing speed corresponding to the selected first color image, wherein one or more second color images are produced; selecting the second color image with the desired quality; and storing a printer parameter corresponding to the selected first and second color images.

Further exemplary embodiments include a method for setting parameters for a two-color point of sale printer including: printing at one or more printing speeds, wherein one or more black images are produced corresponding to each printing speed; selecting the black image with a desired quality; printing a color at one or more energy levels at the printing speed corresponding to the selected black image, wherein one or more second color images are produced; selecting the second color image with a desired characteristic; and storing a printer parameter corresponding to the selected first and second color images, wherein the printer parameter includes the printing speed corresponding to the selected black image and the energy level corresponding to the selected color image.

System and computer program products corresponding to the above-summarized methods are also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

Technical Effects

As a result of the summarized invention, technically we have achieved a solution, which will allow a user to set parameters for a two color thermal printer.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION

Figure 1:
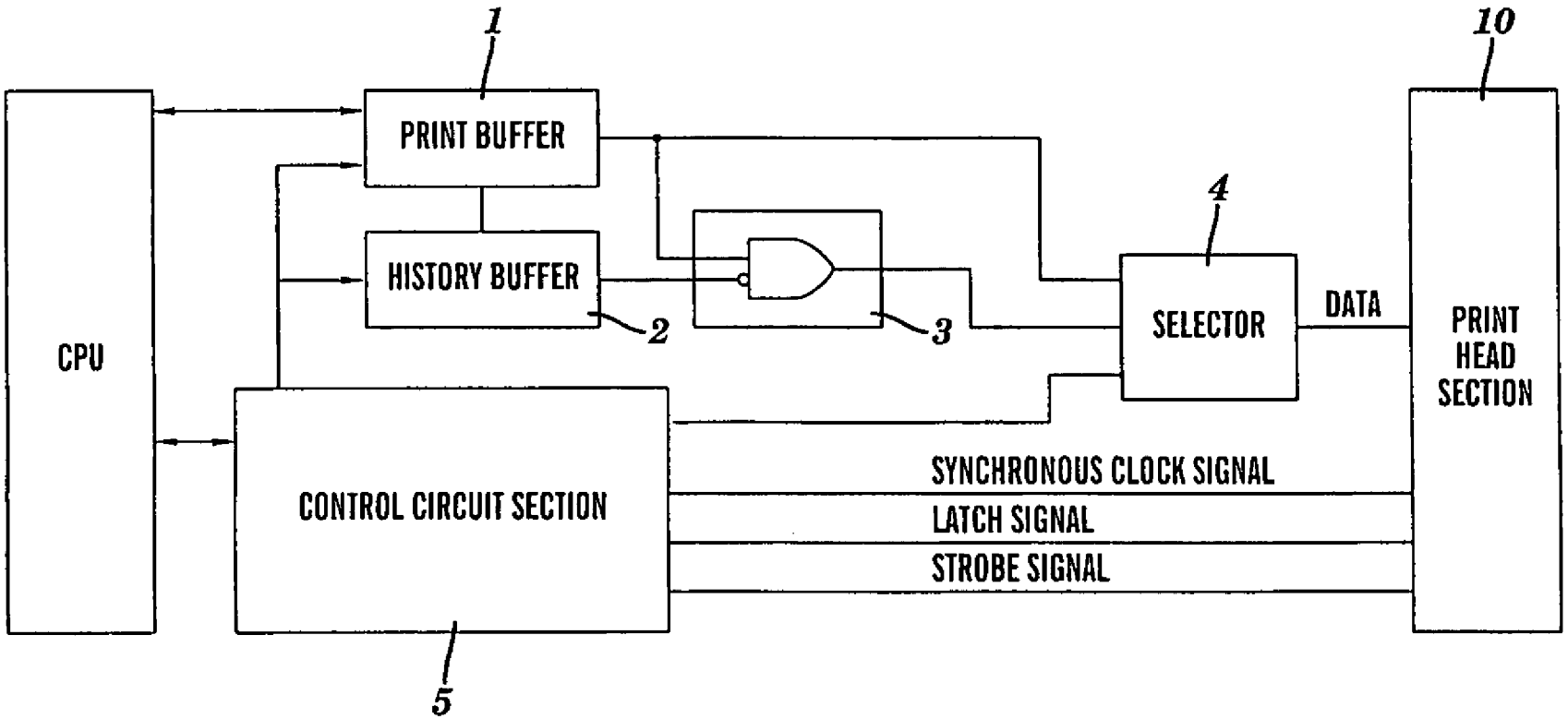
FIG. 1 is a control block diagram of a conventional line thermal printer.

Referring now to FIG. 1, a control block diagram of a conventional line thermal printer in which this print history is used is depicted. One dot line unit of print pixel data received from a host is temporarily stored in a print buffer 1, and sent to a print head unit 10 by way of selector 4. When a next dot line of print pixel data is stored in the print buffer 1, the current data in the print buffer 1 is first moved to a history buffer 2. The data stored in history buffer 2 and data stored in print buffer 1 are then operated on bit-by-bit by logic circuit 3, and output to selector 4. The selector 4 is a type of sequencer and sequentially outputs data from print buffer 1 and data from logic circuit 3 according to a data selection signal from control circuit section 5. More specifically, the strobe period is divided into a part (period 1) for passing data from print buffer 1, and a part (period 2) for passing data from the logic circuit 3. During period 1 the data selection signal applies data from the print buffer 1 to the print head unit 10, and during period 2 applies data from the logic circuit 3 to the print head unit 10.

A method of avoiding such problems and improving print quality is to store past printed pixel data as a print history. This print history is then used to vary the next pulse width applied to a particular thermal element and adjust the thermal element drive time. Additionally, one method for setting color thermal parameters for thermal printers is to allow a user to select from various pre-defined printing speed and energy levels, which combine to determine the characteristics of the image printed. This method allows the user to manually set both the print speed and energy level used by the printer. The range of available print speeds and energy levels presents the user with 150 or more possible combinations of printing speed and energy level variations. However, since the method does include printing samples of the various combinations the user may not be able to readily visualize the impact on the characteristics of the printed image of the various combinations of printing speed and energy levels.

Figure 2:
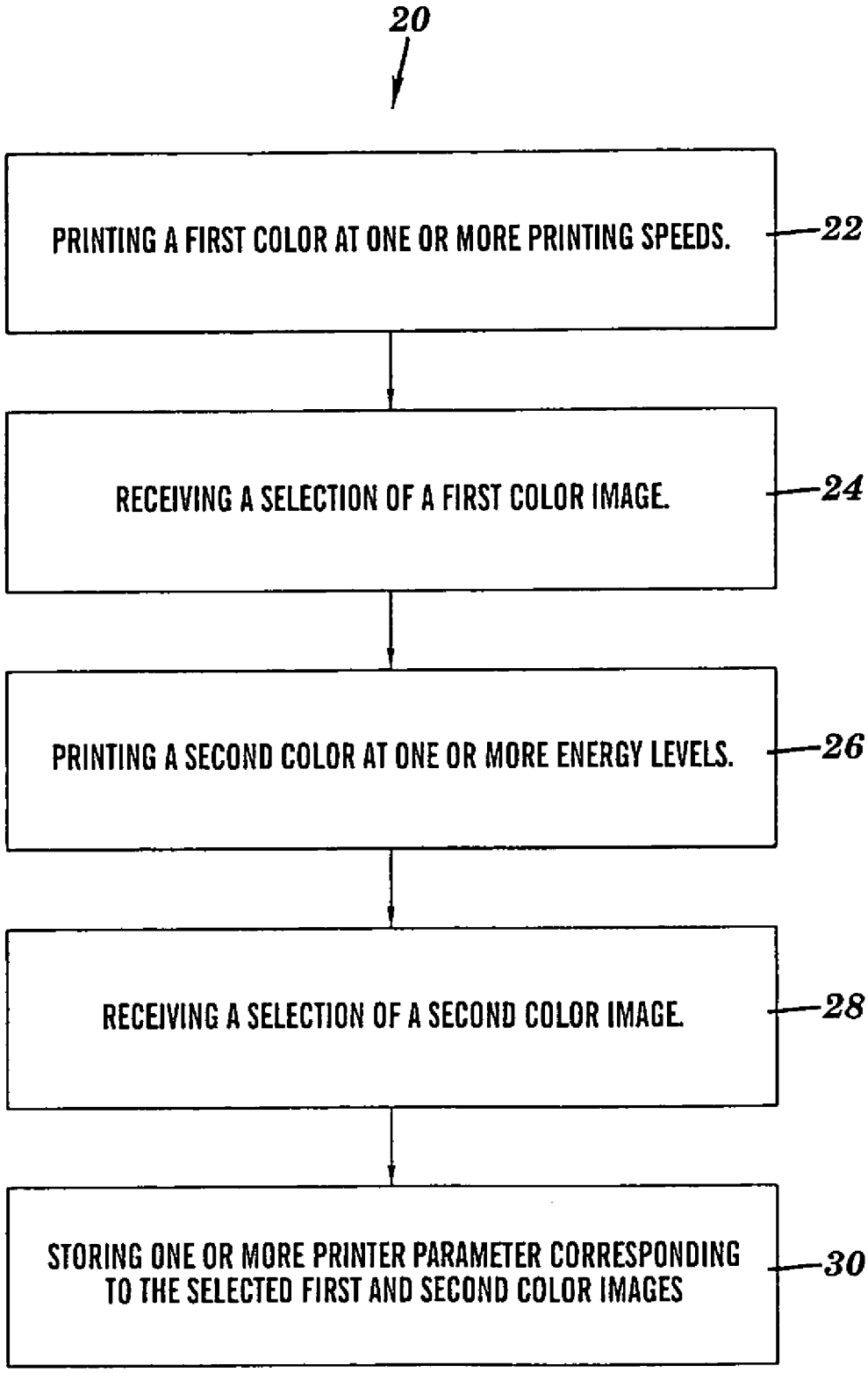
FIG. 2 is a flowchart of an exemplary method for setting color thermal paper parameters.

Turning now to FIG. 2, a flowchart of a method for setting color thermal paper parameters in accordance with an exemplary embodiment is depicted as 20. The first step in the method 20 is printing a first color at one or more printing speeds, as shown at process step 22. Printing the first color at varying speeds produces one or more first color images that each correspond to a distinct printing speed. After printing the first color images, a user selects the first color image that has the desired characteristics, such as image quality, as shown at process step 24. In one embodiment, the first color images may be printed with a corresponding reference character and the user may enter the reference character of the selected image into the printer or a control device attached to the printer (e.g., a computer) to select the corresponding image. In one embodiment, the method 20 may then set the printing speed to the printing speed that corresponds to the selected image.

After receiving a selection of a first color image, the method 20 prints a second color at one or more energy levels at the printing speed corresponding to the selected first color image, as shown at process step 26. Printing the second color at varying energy levels and at a constant printing speed produces one or more second color images that each correspond to a distinct energy level. In exemplary embodiments, the energy levels may be defined as a percentage of the first color energy level. For example, the second color may be achieved by using an energy level ranging from approximately twenty-five to seventy-five percent of the energy level used to create the first color. After creating the second color images, a user selects the second color image that has the desired image characteristics, as shown at process step 28. In a similar manner to that discussed above with reference to the first color images, the second color images may be printed with a reference character that the user may use to select the desired second color image. In one embodiment, the method may then store the energy level corresponding to the selected image. In another embodiment, the method may conclude by storing one or more printer parameters corresponding to the selected first and second color images, as shown at process step 30.

In exemplary embodiments, the thermal printer may include an input device that the user may utilize for selecting the desired first and second color images. The input device may include, but is not limited to, a keyboard, a stylus, a touch screen display, or the like. In one embodiment, the input device may be a keyboard that can be easily attached/detached to the thermal printer. For example, the printer may be a POS printer that includes a communications port, such as a PS2 or Serial port, which allows a user to attach a standard QWERTY keyboard for setting the printing parameters. In addition, the thermal printer may include a reset button or key that allows the user to clear the current settings and restore default settings. Furthermore, the thermal printer may include a set printing parameters button or key that invokes the method 20 for setting color thermal paper parameters described above.

While the above method has been described with reference to the use of a two color thermal printer, it will be appreciated by those of ordinary skill in the art that the method may be applied to color thermal printers that include a plurality of colors. Additionally, the method for setting printer parameters may also be used with a wide range of printers and is not intended to be limited to the use of thermal printers. The method could be used with any color printer that allows a user to set various parameters that impact the characteristics of the images produced including, but not limited to, print speed, print quality (e.g., dpi), or the like.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method for setting color thermal paper parameters comprising:

printing a first color at one or more printing speeds, wherein one or more first color images are produced;

selecting the first color image with a desired quality;

printing a second color at one or more energy levels at the printing speed corresponding to the selected first color image, wherein one or more second color images are produced;

selecting the second color image with a desired characteristics; and storing a printer parameter corresponding to the selected first and second color images.

2. The method of claim 1, wherein at least one of the first color or the second color is black.

3. The method of claim 2, wherein the printer parameter includes a printing speed.

4. The method of claim 3, wherein the printer parameter further includes an energy level.

5. A method for setting parameters for a two-color point of sale printer comprising:

printing at one or more printing speeds, wherein one or more black images are produced corresponding to each printing speed;

selecting the black image with a desired quality;

printing a color at one or more energy levels at the printing speed corresponding to the selected black image, wherein one or more second color images are produced;

selecting the second color image with a desired characteristic; and storing a printer parameter corresponding to the selected first and second color images, wherein the printer parameter includes the printing speed corresponding to the selected black image and the energy level corresponding to the selected color image.

* * * * *